United States Patent [19]

Simo

[11] 4,203,601

[45] * May 20, 1980

[54] ARROWHEAD

[75] Inventor: Miroslav A. Simo, Riverside, Ill.

[73] Assignee: New Archery Products Corp., Riverside, Ill.

[ * ] Notice: The portion of the term of this patent subsequent to Feb. 8, 1994, has been disclaimed.

[21] Appl. No.: 910,120

[22] Filed: May 30, 1978

Related U.S. Application Data

[63] Continuation-in-part of Ser. No. 853,488, Nov. 21, 1977, which is a continuation-in-part of Ser. No. 738,030, Nov. 2, 1976, Pat. No. 4,093,230, which is a continuation-in-part of Ser. No. 619,824, Oct. 6, 1975, Pat. No. 4,006,901.

[51] Int. Cl.[2] ..... F41B 5/02

[52] U.S. Cl. ..... 273/421

[58] Field of Search ..... 273/106.5 R, 106.5 B

[56] References Cited

U.S. PATENT DOCUMENTS

| | | | |
|---|---|---|---|
| 2,816,766 | 12/1957 | Stockfleth | 273/106.5 B |
| 2,925,278 | 2/1960 | Sweetland | 273/106.5 R |
| 2,940,758 | 6/1960 | Richter | 273/106.5 B |
| 3,527,463 | 9/1970 | Turner | 273/106.5 B |
| 3,741,542 | 6/1973 | Karbo | 273/106.5 B |
| 3,756,600 | 9/1973 | Maleski | 273/106.5 B |
| 3,854,723 | 12/1974 | Wilson | 273/106.5 B X |
| 3,893,866 | 7/1975 | Hollingsworth | 273/106.5 B X |
| 4,006,901 | 2/1977 | Simo | 273/106.5 B X |
| 4,093,230 | 6/1978 | Simo | 273/106.5 B |

*Primary Examiner*—William H. Grieb
*Attorney, Agent, or Firm*—Thomas W. Speckman

[57] ABSTRACT

An arrowhead assembly for easy attachment to and removal from the head end of an arrow shaft. The arrowhead body has a through opening centered on its long axis into which fits an adapter shaft at the head end of the arrow shaft or a nosepiece shaft or a combination of these all in fixed relation to the arrow shaft. The arrowhead body of this invention allows the choice of freely rotatable movement of a blade carrying arrowhead body with respect to the nosepiece and arrow shaft or fixed position with respect thereto. The arrowhead body of this invention affords easy exchangeability of arrowhead bodies having different numbers or designs of blades or no blades and different weights on the same arrow shaft and nosepiece assembly.

27 Claims, 3 Drawing Figures

ARROWHEAD

CROSS REFERENCE TO RELATED APPLICATIONS

This application is a continuation-in-part of my copending application Ser. No. 853,488, filed Nov. 21, 1977, which was a continuation-in-part of application Ser. No. 738,030, filed Nov. 2, 1976, now U.S. Pat. No. 4,093,230 which was a continuation-in-part of application Ser. No. 619,824, filed Oct. 6, 1975, now U.S. Pat. No. 4,006,901.

This invention relates to an arrowhead and an arrowhead body or cartridge which is useful for target shooting simulated for hunting and provides easy and safe exchange of multiple blade arrowhead body units having different weights and numbers of blades and blade configurations and the choice of having the arrow shaft rotate or remain stationary relative to the blades during penetration of a target.

A number of attempts have been made to provide arrowheads with replaceable cutting blades, but these have not been entirely satisfactory. For example, the arrow tip disclosed in U.S. Pat. No. 3,756,600 shows the use of razor blades held in grooves of an arrow tip by a snap ring. However, this design is not entirely satisfactory since it is dangerous, difficult and time consuming to replace the blades and the shape of the blades provides a barb at the rear end which renders them unlawful for use in many states. Further, the arrowhead of the U.S. Pat. No. 3,756,600 is fixed with respect to rotation of the arrow shaft and this fixed relation greatly reduces forward penetration energy. Other attempts to solve the problem of providing readily replaceable blades to arrowheads are illustrated in U.S. Pat. Nos. 3,741,542, 3,854,723 and 2,940,758. The arrowheads as taught by each of these patents have the disadvantage of blades being individually mounted which makes them dangerous and difficult to readily exchange, particularly in the field under hunting conditions which includes the hunter standing on a treestand 10 to 20 ft. off the ground. U.S. Pat. No. 2,816,766 teaches a plastic bodied arrowhead which snaps onto the end of the arrow shaft. However, I have found it advantageous for the blade carrying arrowhead body to have a through opening to fit over a shaft and to provide a nosepiece separate from the blade carrying arrowhead body so as to transmit impact forces directly to the arrow shaft. Rotating arrow tips are also known to the art as disclosed in U.S. Pat. No. 3,527,463, however, arrow tips such as disclosed in that patent are not readily exchangeable, present difficulty in alignment of the arrowhead with the arrow shaft and do not provide for rotation of the blades relative to the tip portion. The entire arrowhead of one embodiment of the present invention rotates with the arrow shaft while in flight, but upon initial penetration of a target material the blade portion ceases to rotate relative to the arrow shaft and nosepiece which creates a longer transition time for the arrow shaft to go from the spin phase to the no spin phase. This longer and smoother transition time lessens removal of forward penetration energy from the arrow so that a greater quantity of the arrow's energy is available for forward penetration into the target material. Further, the rotating blade portion allows the arrow to seek a path of least resistance through the target by a slight rotation of the blade portion.

Hunting arrowheads having sharpened steel blades firmly mounted within an arrowhead body have been more fully described in my prior patent applications identified above. Use of such arrowheads for practice or target shooting ruins them for hunting, but practice is necessary to gain proficiency with a certain arrowhead design. To my knowledge, there have not previously been available target arrowheads simulating the flight characteristics of and having the same weight characteristics as the above described hunting arrowheads.

It is an object of this invention to provide practice or target arrowheads for simulation of flight characteristics of hunting arrowheads.

It is an object of this invention to provide a readily removable arrowhead body affording good alignment with the arrow shaft and easy means for securement of the arrowhead body to the arrow shaft.

It is an object of this invention to provide an arrowhead wherein the blade carrying arrowhead body may be readily exchangeable, a hunting or a target arrowhead body having the same weight and flight characteristics being interchangeable.

It is another object of this invention to provide a readily exchangeable arrowhead body in which all of the blades may be molded as a unit.

It is yet another object of this invention to provide a readily removable arrowhead wherein the arrowhead body including all of the blades can be adjusted to rotate or to remain stationary with respect to the arrow shaft and nosepiece as desired.

It is another object of this invention to provide a target arrowhead having the same blade configuration and weight as a hunting arrowhead.

It is yet another object of this invention to provide a smoothly streamlined arrowhead body which may have 2 to 7 blades, the larger number of blades reducing the width of the blades, minimizing aerodynamic steering and noise while increasing penetration of a target.

It is another object of this invention to provide improved impact resistance to a plastic arrowhead body.

These and other features and advantages of this invention will become apparent from consideration of the description when taken in conjunction with the drawing showing preferred embodiments of this invention wherein.

Figure 1:
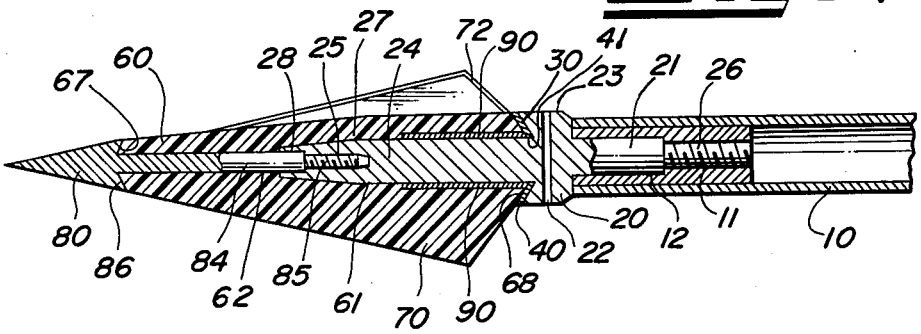
FIG. 1 is a side partial sectional view of an arrowhead incorporating principles of one embodiment of this invention in the assembled postion on an arrow shaft.

The arrowhead of this invention has three principal components shown in the drawings as nosepiece 80, arrowhead body 60 and adapter 20 for securing the arrowhead assembly to arrow shaft 10. Body spacer 40 is used when it is desired that arrowhead body 60 carrying blades 70 not rotate with respect to arrow shaft 10 and nosepiece 80 upon penetration of a target. The arrowheads may be assembled as more fully described in my earlier filed patent applications identified above and incorporated herein by reference in their entirety.

Figure 2:
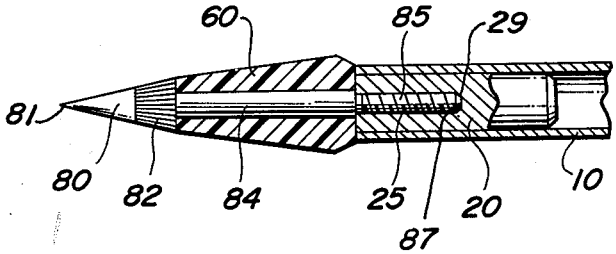
FIG. 2 is a side partial sectional view of an arrowhead of another embodiment of this invention.

Arrowhead body 60 may carry blades 70 as shown in FIG. 1 to simulate a hunting arrowhead in shape characteristics and have weight sleeve 90 to provide very similar weight characteristics. Arrowhead body 60 may also be smooth, without blades as shown in FIG. 2, to provide different weight characteristics to target arrowheads.

The arrowhead body of this invention may be an elongated body of any suitable exterior shape having a through opening of any suitable interior shape centered on its long axis. The arrowhead body should be symmetrical about its long axis to provide desired weight and balance characteristics for good flight.

The through opening of the arrowhead body may be a straight cylinder, a truncated cone shape or a cylinder or cone having one or more steps in diameter if it is desired that the arrowhead body rotate with respect to the arrowshaft and nosepiece. Such rotation may be restricted when desired by use of a filler washer 40 as shown in FIG. 1. If it is not desired for the arrowhead body to rotate, the through opening, or a portion of it, may have any polyagonal cross section shape such as triangular, rectangular, pentagular and the like. The essential requirement is that the arrowhead body have a through opening centered on its long axis and that the arrowhead body be symmetrical with respect to its long axis.

In the embodiment shown in FIG. 1 for assembly of an arrowhead using an arrowhead body of this invention, adapter 20 is first tightened into aligned relationship with arrow shaft 10. Adapter 20 has arrow shaft extension portion 23 which may be approximately the same shape and diameter as the end of arrow shaft 10. Adjacent to arrow shaft extension portion 23 is adapter shaft 21 of smaller diameter and providing snug fitting relationship with adapter shaft receiving cylinder 12 in the end of arrow shaft 10. At the end of adapter 20 received within arrow shaft 10 is adapter threaded shaft 26 which is received in threaded relationship by matching thread receiving cylinder 11 in shaft 10. Thus, adapter 20 may be tightened in rigid aligned position with respect to arrow shaft 10 by fully tightening the screw threads of adapter threaded shaft 26, thereby obtaining a tight, adjacent shoulder relationship with the shoulders between adapter threaded shaft 26 and adapter shaft 21 and between adapter shaft 21 and arrow shaft extension portion 23. Tightening of adapter 20 may be facilitated by insertion of a still piece of wire or other material through tightening hole 22 to serve as a handle for the tightening action. Adapter 20 has adapter shaft 24 of suitable length and diameter to loosely fit within adapter shaft cylinder 61 of arrowhead body 60. Adapter shaft 24 may extend to the forward end of arrowhead body 60 or extend partially through arrowhead body 60 as shown in FIG. 1. Adapter shaft 24 or adapter shaft cylinder 61 may have a friction ring or other suitable shape protruding from the surface to create sufficient friction to prevent rotation while passing through the air. The looseness of this fit should not permit undesired wobble or rattle but should permit easy rotation of arrowhead body 60 around adapter shaft 24 upon penetration of an object. The forward end of adapter shaft 24 has a nosepiece receiving cylinder with threaded portion 25 matching the threads of nosepiece threaded shaft 85 and smooth portion 28. The smooth portion provides greater strength to nosepiece shaft 84. It is preferred that the forward end of adapter shaft 24 have tapered portion 27 to provide greater length to smooth portion 28 of the nosepiece receiving cylinder while providing maximum thickness to arrowhead body 60.

It must be appreciated that an essential feature of adapter 20 as shown in FIG. 1 is the provision of adapter shaft 24 and nosepiece threaded receiving cylinder 25. It is within this invention that adapter shaft 24 and nosepiece threaded receiving cylinder 25 be provided by shaping the end of arrow shaft 10, thus not requiring a separate adapter 20. In this embodiment the nosepiece is screwed into the shaped forward end of the arrow shaft. This is shown in FIG. 7 of U.S. Pat. No. 4,006,901, the disclosure of which is incorporated herein by reference in its entirety. Likewise, when wooden arrow shafts are used, an adapter providing adapter shaft 24 and nosepiece receiving cylinder 25 may be glued over the end of the wooden shaft. As shown in FIG. 1, arrow shaft 10 is a hollow aluminum or fiberglass shaft with an adapter plug with adapter shaft receiving cylinder 12 fastened in the end of the shaft to receive adapter shaft end 21 and adapter threads 26. Arrow shaft extension portion 23, although shown in the figures as nearly the same diameter as arrow shaft 10, may be either larger or smaller in diameter. Nosepiece shaft 84 may extend entirely through the arrowhead body and fasten directly into fastening means in the head end of arrow shaft 10 eliminating the adapter shaft as shown in FIG. 2.

Arrowhead body 60 may carry the desired number of blades 70 which may be molded plastic and simulate the hunting arrowhead. The weight of the hunting arrowhead may be simulated by suitably heavy weight sleeve 90. Weight sleeve 90 may be used in any of the embodiments shown in the figures to bring the arrowhead to the desired weight. Two to about 7 blades are suitable, dependent upon the purpose of the arrowhead. Blades 70 may be of any desired shape having straight, concave or convex leading edges. It is desired that the trailing edge of the blades not have a barb, but present easy withdrawal from a target. Sharpened trailing edge 72 provides for easy removal of the arrowhead after penetration into a body. The shape of blades 70 as shown in the figures is particularly preferred since it affords a continuously streamlined shape minimizing the overall diameter of the arrowhead when multiple blades, such as five, are used.

When the front of arrowhead body 60 is flat, as shown in U.S. Pat. No. 4,006,901, I have found that during severe destructive testing of shooting the arrowhead into a brick, the front portion of a plastic arrowhead body 60 may crack on occasion. While this does not affect the arrowhead in normal use, it is preferred that the arrowhead be able to strike a rock, as may occur during hunting, without suffering any damage. It is preferred that the forward end of arrowhead body 60 have tapered portion 67 to fit a matching tapered portion 86 within nosepiece 80. I have found that with tapered portion 67 the arrowhead can be shot into a brick along a line perpendicular to its surface without damage to the front portion of a plastic arrowhead body 60. The arrowhead body may be similarly tapered at the rear end as shown in FIG. 1 with tapered portion 68 to fit matching tapered portion 30 of adapter 20. With such tapered portions impact forces are used to hold the arrowhead body together.

Figure 3:
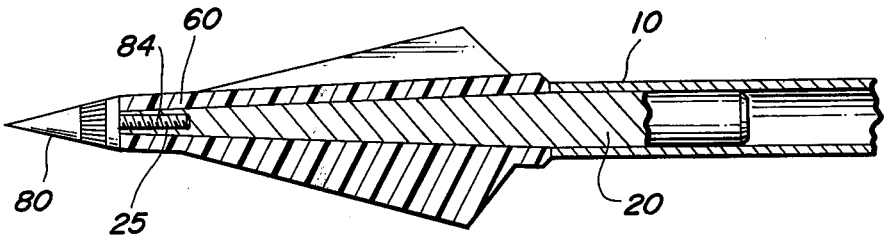
FIG. 3 is a side partial sectional view of an arrowhead of another embodiment of this invention.

As shown in FIGS. 1 and 3, nosepiece 80 holds arrowhead body 60 in place upon adapter 20. Nosepiece 80 has nosepiece shaft 84 terminating in nosepiece threaded shaft 85 for screwable insertion into matching threaded portion 25 of nosepiece receiving cylinder in adapter shaft 24. It is preferred that nosepiece shaft 84 be smaller in diameter for its full length than adapter shaft 24 to provide for thicker arrowhead body 60.

Nosepiece 80 has hollow tapered portion 86 to receive tapered portion 67 of arrowhead body 60. Nosepiece 80 may have conical point 81 upon which serrations 82 may be provided toward the larger end as shown in FIG. 2. Nosepiece 80 may have a tapered point of polygonal cross section having flats 87 shown in FIGS. 7 and 8 of application Ser. No. 738,030, the disclosure of which is incorporated herein in full by reference. Point 81 may be sharpened and of a hardened material, such as steel, to facilitate deeper penetration upon striking an object or may be slightly blunt to prevent curling upon striking a hard object. Serrations 82 may also be of a sharpened knife-like configuration to facilitate entry of the arrowhead point into an object. Nosepiece shaft 84 and nosepiece shaft cylinder 62 are sized so as to permit rotation of arrowhead body 60 on nosepiece shaft 84. The length of nosepiece shaft 84 is adjusted so that arrowhead body 60 rotates freely on shaft 84 with small clearance between tapered end 67 and hollow taper 86. It is preferred that the threads not extend to the end of nosepiece threads shaft 85 and matching thread cylinder 25 in adapter 20 and that the end of shaft 85 be of truncated cone shape 87 to fit firmly against tapered walls 29 in cylinder 25. When the end of shaft 85 firmly engages the bottom of cylinder 25 in the above manner, the thrust and bending imparted by striking a target is transmitted from nosepiece 80 to adapter 20 to arrow shaft 10. The resistance to bending is also improved by nosepiece receiving cylinder smooth portion 28.

Thus, it is seen that use of an arrowhead body with a through opening according to this invention permits use of a separate nosepiece affording transmission of a large proportion of the impact forces from the nosepiece to the arrow shaft without passing through the arrowhead body. Such construction is especially desirable when lightweight plastics are used for the arrowhead body. Further, the separate nosepiece and adapter will also absorb compressive forces experienced by the blades during actual penetration after the impact. Therefore, both the impact forces and the penetration forces are transmitted through the shaft passing through the central portion of the arrowhead body.

As described above, arrowhead body 60 may be freely rotatable with respect to arrow shaft 10 and nosepiece 80. If it is desired to prevent the rotation of arrowhead body 60, body spacer 40 having hole 41 loosely fitting over adapter shaft 24 may be used. Body spacer 40 may be inserted over adapter shaft 24 between arrowhead body 60 and arrow shaft extension portion 23 so that when nosepiece 80 is tightened arrowhead body 60 is held firmly and in non-rotatable relation with arrow shaft 10 and nosepiece 80.

While the above description has referred to threaded fastening means for assembling the nosepiece, adapter and arrow shaft, it is recognized that any suitable fastening means may be used. For example, bayonet or O-ring and groove fastening means may be used. The terminology fastening means is meant to include all appropriate fastening methods for assembling the nosepiece to the adapter and arrow shaft.

FIG. 2 shows another embodiment of an arrowhead body according to this invention without blades. In this embodiment the through opening of the arrowhead body is a straight uniform cross section area opening. Also in FIG. 2 nosepiece shaft 84 is shown extending fully through the central opening of the arrowhead body and fastening securely in adapter shaft 20 head end within arrow shaft 10.

FIG. 3 shows another embodiment of an arrowhead body of this invention wherein the through opening is tapered and nosepiece shaft 84 is shown fastening within tapered portion of adapter shaft 20 extending fully through the central opening of the arrowhead body. It should also be apparent that in cases where the adapter shaft extends fully through the central opening of the arrowhead body, the arrowhead body may advantageously taper to smaller cross section toward the rear end affording a thicker portion of the arrowhead body for more rigidity in the forward sections. The through opening may also be a combination tapered and stright and/or stepped opening.

The components of the arrowhead using the arrowhead body of this invention may be fabricated from any suitable materials. It is preferred that the nosepiece be fabricated from hardened steel. In order to minimize weight of the arrowhead assembly, it is preferred that any adapter be fabricated from aluminum, titanium, magnesium and alloys or other lightweight metal alloy. It is preferred that the nosepiece and adapter be metal since they must resist both thrust and bending forces when the arrowhead strikes a target. The arrowhead body is suitably fabricated from any suitable weight, high impact resistant material. Lightweight moldable materials are preferred. Synthetic polymeric materials such as nylon, polyethylene, polystyrene, polycarbonate, polyacetal, polysulfone, polyphenyleneoxide, polyesters and the like are suitable. The synthetic polymer materials may be reinforced by any method known to the art, such as incorporation of fibers, such as fiber glass. The synthetic polymeric materials may be weighted by addition of metallic fillings to simulate the weight of hunting arrowheads having metal blades. Also suitable are moldable metals or metals suitable for forming into moldable shape by powdered metallurgical processes. Suitable metals include aluminum, titanium, magnesium and their alloys or other lightweight metal or alloy. The weight sleeve may be any suitable metal to add sufficient weight to the target arrowhead so that it will simulate the hunting arrowhead. The materials of construction may be selected so that the arrow and arrowhead assembly have a similar weight distribution as a hunting arrow and thus, the shooter does not have to allow for different arrow trajectory when he switches from target points to the arrowhead of this invention.

As can be readily seen from the above description, a wide variety of arrowhead bodies carrying different configurations and numbers of blades may be interchanged using the same arrow shaft and nosepiece. Thus, the different arrowhead bodies with or without blades and adjusted to desired weight by a weight sleeve or weight filler may be marketed separately for interchange on an arrow shaft.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrowhead assembly for attachment to the head end of an arrow shaft comprising:

an adapter shaft having a head end and tail end, said tail end having fastening means for securement to said head end of an arrow shaft and means for fastening a nosepiece at said adapter shaft head end;

an arrowhead body forming a hollow cylinder, said hollow cylinder having a diameter greater than said adapter shaft providing freely rotatable movement when said adapter shaft is inserted in said hollow cylinder;

a tapered nosepiece having a fastening means at its tail end for mating with said fastening means in the head end of the adapter shaft fastening said nosepiece in fixed relation to said adapter shaft and said arrow shaft.

2. The arrowhead assembly of claim 1 wherein the forward end of said arrowhead body has a forwardly reducing taper and said nosepiece has a hollow taper portion to receive said tapered forward end of said arrowhead body while allowing freely rotatable movement of said arrowhead body.

3. The arrowhead assembly of claim 1 wherein said arrowhead body is a high impact resistant moldable plastic having a substantially smooth exterior surface.

4. The arrowhead assembly of claim 1 wherein said arrowhead body is a high impact resistant moldable plastic having integrally molded blades.

5. The arrowhead assembly of claim 4 wherein said arrowhead body has 2 to about 7 integrally molded blades.

6. The arrowhead assembly of claim 5 wherein said arrowhead body has 5 integrally molded blades.

7. The arrowhead assembly of claim 1 wherein said nosepiece when fastened to said adapter shaft firmly engages the adapter shaft so that the thrust and bending imparted upon striking a target is transmitted from the nosepiece to the adapter.

8. The arrowhead assembly of claim 1 wherein said adapter shaft is provided by shaping said head end of an arrow shaft and providing means for fastening a nosepiece at said adapter shaft head end.

9. The arrowhead assembly of claim 1 additionally having a weight sleeve within said arrowhead body hollow cylinder.

10. An arrowhead assembly for attachment to the head end of an arrow shaft comprising:

an adapter having a head end and tail end, said tail end having fastening means for securement to said head end of an arrow shaft and means for fastening a nosepiece at said adapter head end;

a tapered nosepiece having a shaft portion with fastening means at its tail end for mating with said fastening means in the head end of the adapter fastening said nosepiece in fixed relation to said adapter and said arrow shaft; and an arrowhead body forming a hollow cylinder, said hollow cylinder having a diameter greater than said nosepiece shaft portion providing freely rotatable movement when said nosepiece shaft portion is inserted in said hollow cylinder.

11. The arrowhead assembly of claim 10 wherein said arrowhead body is a high impact resistant moldable plastic having a substantially smooth exterior surface.

12. The arrowhead assembly of claim 10 wherein said arrowhead body is a high impact resistant moldable plastic having integrally molded blades.

13. The arrowhead assembly of claim 12 wherein said arrowhead body has 2 to about 7 integrally molded blades.

14. The arrowhead assembly of claim 10 additionally having a weight sleeve within said arrowhead body hollow cylinder.

15. An elongated arrowhead body having integrally molded tapered blades extending from the exterior of said body, said blades extending further from the exterior of said body toward the arrow shaft providing a streamlined shape, said body having a through opening centered on its long axis, said opening adapted to receive a shaft portion of a nosepiece or adapter forming an assembled archery arrow having said arrowhead body between said nosepiece and arrow shaft.

16. The arrowhead body of claim 15 wherein said through opening is a straight round cylinder.

17. The arrowhead body of claim 15 wherein said through opening is a tapered round cylinder.

18. The arrowhead body of claim 15 wherein said through opening is a truncated cone.

19. The arrowhead body of claim 15 wherein said through opening is a tapered truncated cone.

20. The arrowhead body of claim 15 wherein said through opening is a polyagonal cross section.

21. The arrowhead body of claim 20 wherein said through opening is a triangular cross section.

22. The arrowhead body of claim 15 wherein said body is high impact moldable plastic.

23. The arrowhead body of claim 22 having 2 to about 7 integrally molded blades.

24. The arrowhead body of claim 23 having 3 integrally molded blades.

25. The arrowhead body of claim 15 wherein the forward end of said arrowhead body is tapered.

26. The arrowhead body of claim 15 wherein the rearward end of said arrowhead body is tapered.

27. The arrowhead body of claim 15 wherein said through opening is circular in cross section and sized to rotate about said shaft portion.

* * * * *